US007804015B1

(12) United States Patent
Wilson

(10) Patent No.: US 7,804,015 B1
(45) Date of Patent: Sep. 28, 2010

(54) MUSICAL INSTRUMENT ASSEMBLY

(76) Inventor: Jordan Wilson, 356 Fairway, Wichita, KS (US) 67212

( * ) Notice: Subject to any disclaimer, the term of this patent is extended or adjusted under 35 U.S.C. 154(b) by 0 days.

(21) Appl. No.: 12/696,337

(22) Filed: Jan. 29, 2010

(51) Int. Cl.
*G10D 13/02* (2006.01)

(52) U.S. Cl. ..... 84/422.1

(58) Field of Classification Search ..... 84/420, 84/422.1, 422.2, 422.3
See application file for complete search history.

(56) References Cited

U.S. PATENT DOCUMENTS

| | | | | |
|---|---|---|---|---|
| 2,845,830 | A | 8/1958 | Haviland | |
| 3,747,464 | A | 7/1973 | Russell | |
| 4,747,333 | A | 5/1988 | Hoshino | |
| 5,267,500 | A * | 12/1993 | Lombardi | 84/402 |
| 5,789,688 | A | 8/1998 | Schiano | |
| 5,990,401 | A | 11/1999 | Braun | |
| 6,201,173 | B1 | 3/2001 | Black | |
| 6,278,046 | B1 | 8/2001 | Sikra et al. | |
| 6,307,136 | B1 | 10/2001 | Sikra et al. | |
| 6,977,333 | B2 | 12/2005 | Sutej | |
| 7,115,805 | B1 | 10/2006 | Vandervoort | |
| 7,232,947 | B1 | 6/2007 | Lombardi | |
| 2007/0234876 | A1 | 10/2007 | Veiga | |

FOREIGN PATENT DOCUMENTS

| | | |
|---|---|---|
| DE | 4408726 | 9/1995 |
| DE | 4409441 | 9/1995 |
| WO | WO 03/081571 | 10/2003 |

* cited by examiner

*Primary Examiner*—Kimberly R Lockett
(74) *Attorney, Agent, or Firm*—Kenneth H. Jack; Davis & Jack, L.L.C.

(57) ABSTRACT

A musical instrument assembly including a support frame; at least a first lateral slide bar; a slide shaft and slide sleeve assembly interconnecting the at least first lateral slide bar and the support frame; a cable pull actuator having upwardly extended contact pedal; a "C" channel assembly interconnecting the cable pull actuator and the at least first lateral slide bar; a percussion instrument; an instrument striker; a striker driver operatively interconnecting the instrument striker and the percussion instrument; and a flexible tube and cable combination interconnecting the cable pull actuator and the striker driver for, upon foot driven retraction of the cable pull actuator's contact pedal, actuating the striker driver for percussive contact of the instrument striker against the percussion instrument.

20 Claims, 5 Drawing Sheets

MUSICAL INSTRUMENT ASSEMBLY

FIELD OF THE INVENTION

This invention relates to musical instruments. More particularly, this invention relates to assemblies for foot pedal actuation of percussion instruments.

BACKGROUND OF THE INVENTION

Instrumentalist musicians who, while performing, occupy both of their hands in manipulation of an instrument such as a guitar, a violin, or a harmonica, often play while seated. While such musicians are seated, they are often able to freely move their left and right feet for simultaneous and musically complementing actuation of other instruments, particularly percussion instruments.

While it is often desirable for a musician to utilize his or her feet for percussion instrument playing while simultaneously occupying his or her hands with the playing of another instrument, commonly known assemblies for effectuating and facilitating foot actuated instrument play are typically defective and deficient in various ways.

Known foot actuated percussion instrument playing assemblies typically lack any structural feature or characteristic of versatility and interchangeability in instrument set up or configuration for hands free playing of multiple percussion instruments. Also, such known assemblies are typically difficult and awkward to assemble and disassemble or to configure for convenient reach and access by a musician's feet to the assembly's actuator pedals.

The instant inventive musical instrument assembly solves or ameliorates defects and deficiencies such as are described above by providing a specialized support frame and associated actuator assemblies which, in combination with one or more percussion instruments, allows a musician to utilize his or her feet for conveniently and ergonomically playing such instruments, and which allow the musician to easily and conveniently configure and reconfigure the assembly for playing of varying arrays of and assortments of percussion instruments.

BRIEF SUMMARY OF THE INVENTION

A first structural component of the instant inventive musical instrument assembly comprises a support frame. Preferably, the support frame comprises a four legged box frame structure whose structural support members comprise steel square tubes. In a preferred embodiment, the support frame has a lateral dimension between 2½ feet and 4½ feet, a longitudinal or rear to front dimension between 1½ and 3 feet, and has a vertical dimension between eight inches and 1½ feet. Preferably, the support frame is configured for resting upon a floor surface.

A further structural component of the instant inventive musical instrument assembly comprises at least a first laterally extending actuator pedal support bar. In the preferred embodiment, a plurality of second laterally extending actuator pedal support bars are provided. Preferably, each of the actuator pedal supporting lateral bars extends the full lateral width of the support frame, and each is preferably composed of steel square tubing or steel bar stock having a square or rectangular lateral cross sectional shape.

First mounting means are preferably provided for attaching the lateral bars to the support frame. In the preferred embodiment of the instant invention, the first mounting means are configured for facilitating a musician's ability to execute various reconfigurations of the assembly wherein the lateral bars are selectively raised and lowered to desired heights, wherein the longitudinal or front to rear positions of the lateral bars are selectively adjusted, or wherein the lateral bars may be selectively turned and counter-turned about lateral axes for adjustment of their angular orientations. In the preferred embodiment, such multiple capabilities of the first mounting means are facilitated through provision of specialized combinations of slide shafts, slide sleeves, and swivel joints, all operatively interconnecting the lateral bars and the support frame.

A further structural component of the instant inventive musical instrument assembly comprises at least a first cable pull actuator. Preferably, the at least first cable pull actuator comprises a slide shaft and slide sleeve combination wherein the slide shaft presents a pedal contact at its upper end. Preferably, the at least first cable pull actuator presents a rotatable cable turning element which, in combination with an actuator cable fastened to the slide shaft's lower end, facilitates the translation of a longitudinal pulling force to the cable upon downward depression of the actuator's pedal. In the preferred embodiment of the instant invention, a plurality of second cable pull actuators are provided, the number of cable pull actuators being commensurate with the number of instruments to be actuated via the assembly. The multiple positioning capabilities of the first mounting means discussed above provide for widely variable and flexible positioning of the cable pull actuators which are carried upon the lateral bars.

Direct carriage and support of the cable pull actuators is preferably provided by second mounting means which, at a minimum, interconnects the at least first cable pull actuator and a single provided lateral support bar. Preferably, the second mounting means comprises a "C" slot or channel which opens longitudinally from the cable pull actuator for receipt of one of the lateral bars. The second mounting means preferably further comprises releasable locking means which allow the cable pull actuators to securely capture and be fixedly held upon a lateral support bar during instrument playing use, and which alternatively facilitate unlocking and release of the cable pull actuators for repositioning with respect to the support frame.

Further structural components of the instant inventive musical instrument assembly comprise at least a first percussion instrument, such as a drum, a tambourine, cymbals or bells, a striker such as a mallet or drum stick, and a striker driving mechanism. Flexible tube and cable combinations are preferably provided for interlinking the cable pull actuators and the striker driving mechanism. Preferably, each striker driving mechanism grasps, holds, and drives an instrument striker, and each such driver incorporates a spring which normally moves the instrument striker to an upstroke position, while tensioning the pull cable of a connected tube and cable combination. Such spring tension advantageously normally upwardly extends the pedal of the associated cable pull actuator.

In use of the instant inventive musical instrument assembly, a plurality of cable pull actuators having foot contact pedals may be conveniently and ergonomically positioned for remote actuation of a plurality of musical percussion instruments. Also, in use, a musician is able to easily and conveniently configure and reconfigure the assembly for foot playing of various arrays and groupings of remotely located percussion instruments.

Accordingly, objects of the instant invention include the provision of an musical instrument assembly which incorporates structural components, as described above, and which arranges those components with respect to each other in manners described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
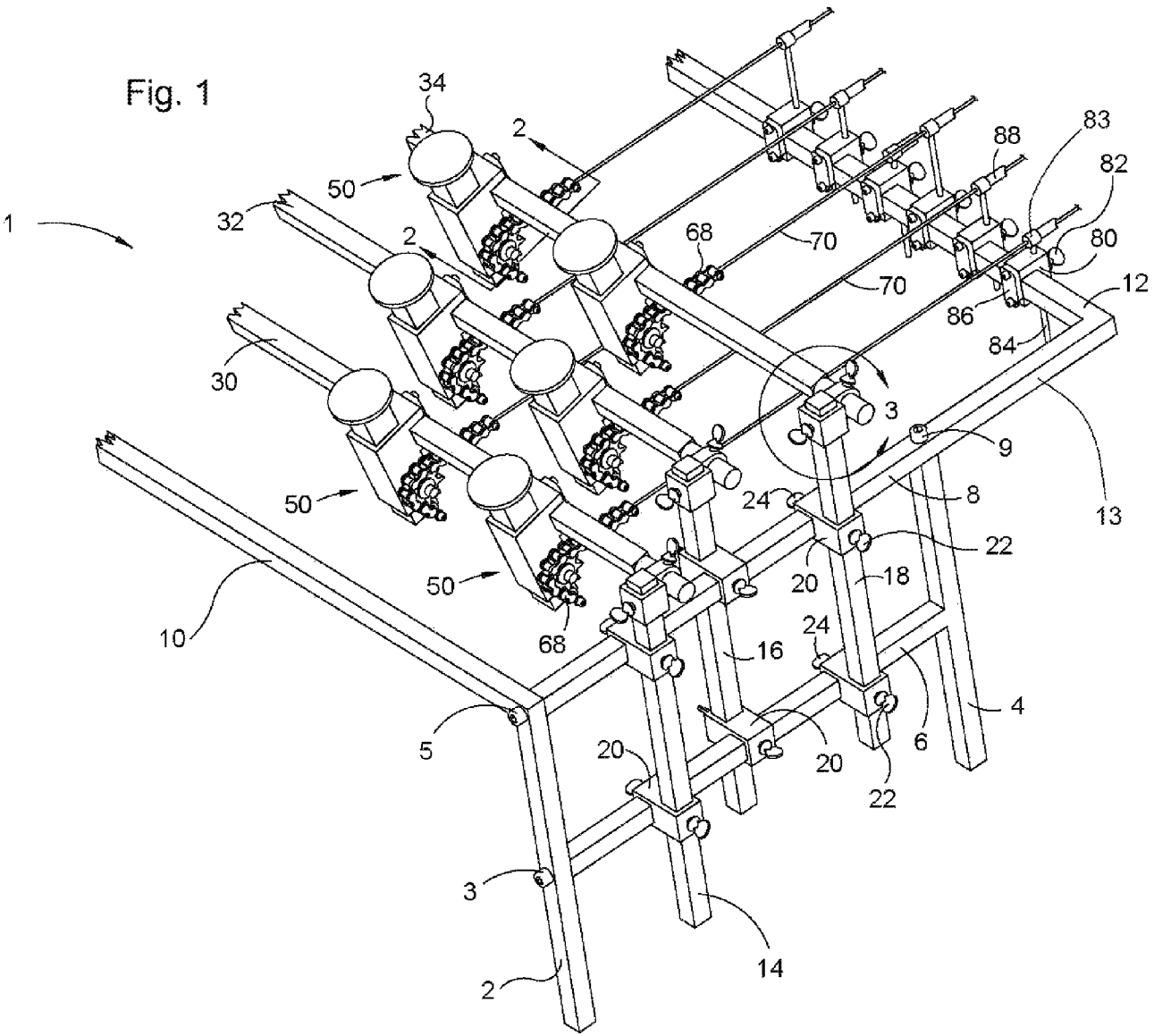
FIG. 1 depicts a rightward portion of a preferred embodiment of the instant inventive musical instrument assembly.

Referring now to the drawings, and in particular to Drawing FIG. 1, a preferred embodiment of the instant inventive musical instrument assembly is referred to generally by Reference Arrow 1. The musical instrument assembly 1 preferably comprises a support frame which comprises front and rear (or longitudinal and oppositely longitudinal) legs 4 and 2. The leftward (or oppositely lateral) portion of the support frame (which is not depicted within the view of FIG. 1) is preferably configured substantially identically, though mirroringly, with the depicted rightward or lateral portion.

The support frame preferably further includes a heel rest bar 10 which laterally spans between and rigidly interconnects the upper ends of the frame's left and right rear legs 2. The support frame preferably further comprises left and right pairs of bars 6 and 8, such bars spanning longitudinally between and rigidly interconnecting the frame's legs 2 and 4. The frame's upper longitudinally extending bars 8 preferably include forwardly extending sections 13 which support a laterally extending cable anchor bar 12.

In the preferred embodiment, the support frame is configured for convenient assembly and disassembly via joint fastening screws 3, 5, and 9. Also, in the preferred embodiment, the support frame is composed of steel square tubing members. Suitably, the support frame may be alternatively composed of solid steel bar stock or aluminum.

Figure 3:
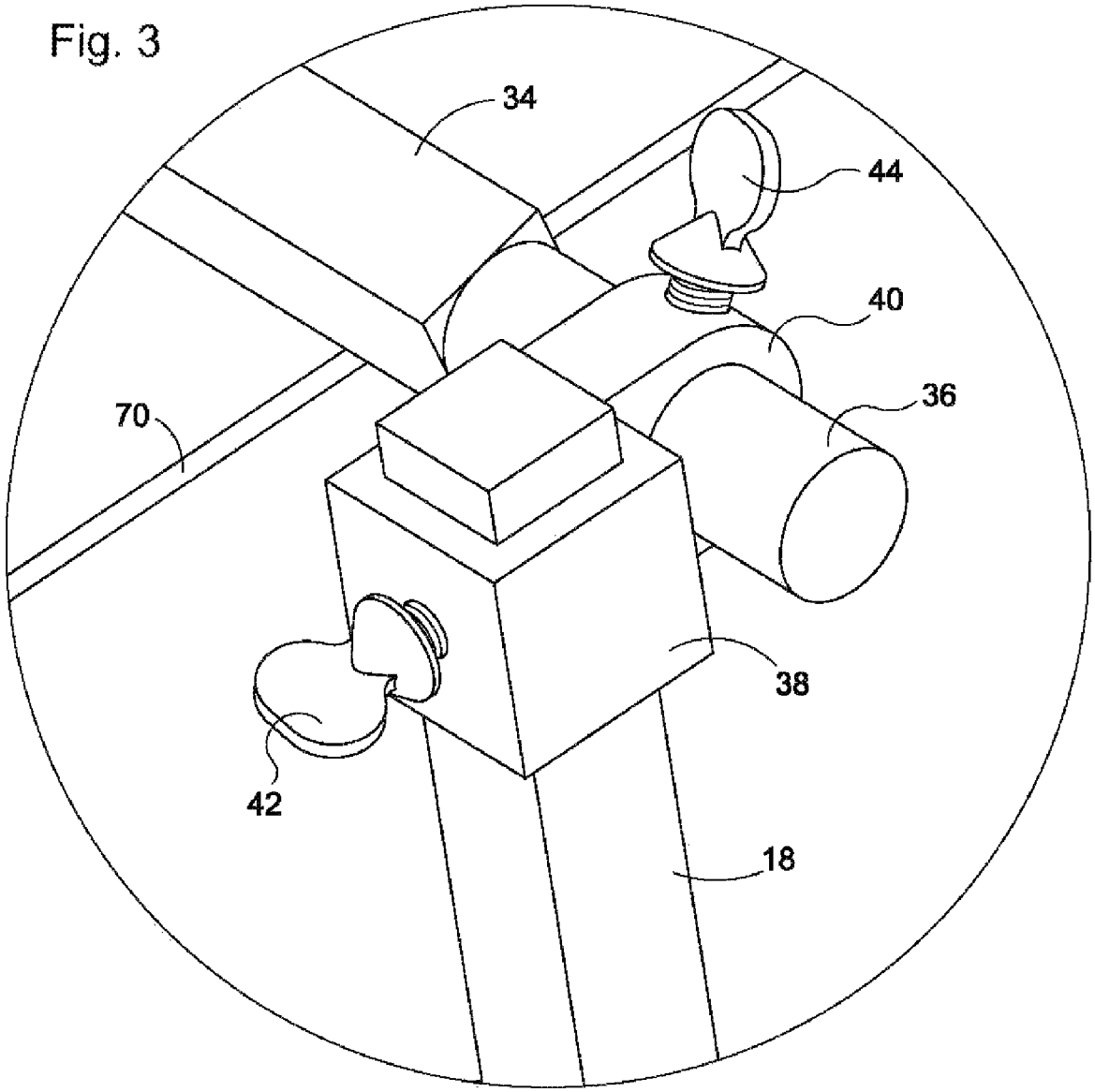
FIG. 3 is a magnified partial view as indicated in FIG. 1.

A further structural component of the instant inventive musical instrument assembly 1 comprises, referring simultaneously to FIGS. 1 and 3, at least a first laterally extending pedal actuator supporting bar 34. Preferably, such bar 34 is composed of steel square tubing. In the preferred embodiment of the instant invention, a plurality of second lateral support bars represented by bars 30 and 32 are additionally provided. Suitably, the instant inventive assembly may be configured to include as few as one of such lateral support bars. The depicted lateral supports bars 30, 32, and 34 are intended to be representative of various pluralities of bars.

Referring to FIG. 1, first mounting means are preferably provided, such means operatively and adjustably interconnecting the lateral support bars 30, 32 and 34 with the support frame. As may be seen in the drawing, lateral support bar 30 is situated at a lowest elevation, lateral support bar 32 is situated at a medial elevation, and lateral support bar 34 is situated at a highest elevation. In order to facilitate such selective vertical positioning of the lateral support bars, the first mounting means are preferably adapted to include right and left or lateral and oppositely lateral vertically oriented bars 14, 16 and 18. Vertically channeled slide sleeves 20 are closely fitted for slidably receiving the bars 14, 16, and 20, and set screws 22 may be manually turned for alternatively clamping against and releasing such bars for vertical position holding and adjustment. The first mounting means component of the instant inventive assembly are considered to include or incorporate the vertically sliding bars 14, 16, and 18, along with their sleeves 20 and set screws 22. Suitably, the first mounting means may alternatively comprise other commonly known fasteners and joint assemblies which are capable of telescoping, retracting, and securely holding a bar or shaft.

Referring further to FIG. 1, the first mounting means are preferably further adapted and configured for facilitating a musician's selective longitudinal positioning and repositioning of the lateral bars 30, 32, and 34. In order to achieve such longitudinal positioning capability, the frame members 6 and 8 are preferably configured for dually functioning as frame structural members, as described above, and as slide bars. Such bars 6 and 8 are preferably closely fitted for nesting receipt within and longitudinal extension through channels within sleeves 20. Set screws 24 are manually operable for selective clamping against and release of the longitudinal slide bars 6 and 8 for alternative holding and repositioning of the vertical bars 14, 16, and 18 along such bars.

Referring simultaneously to FIGS. 1 and 3, the first mounting means are preferably further adapted for enabling the musician to selectively rotatably position the lateral bars 30, 32, and 34. In a preferred embodiment, such rotatable positioning function of the first mounting means is achieved by configuring the lateral ends and oppositely lateral ends of the lateral bars 30, 32, and 34 to be received and rotated within swivel or pivot joints. Such joints preferably comprise cylindrically bored sleeves 40 which rotatably receive cylindrically configured lateral bar ends 36. Set screws 44 allows a musician, upon tightening of the screws, to fix the associated lateral bar 30, 32, or 34 at a selected angular position, and to alternatively release such bar for rotatable repositioning. The sleeves 40 are preferably configured integrally or wholly with a vertically channeled sleeves 38, each of which receives one of the vertical bars 14, 16, or 18. A second set screw 42 allows each of the sleeve combinations 38 and 40 to be selectively vertically positioned upon its vertical bar. Each of the lateral and oppositely lateral ends of the lateral bars 30, 32, and 34 are preferably attached to one of the assembly's vertical bars by an angular position adjusting swivel joint such as is depicted in FIG. 3. The swivel joint assembly depicted in FIG. 3 is intended as being representative of other commonly known joints and fasteners which are capable of alternatively fixing a shaft at a selected angular orientation, and releasing such shaft for rotating movement to a different angular orientation.

Figure 2:
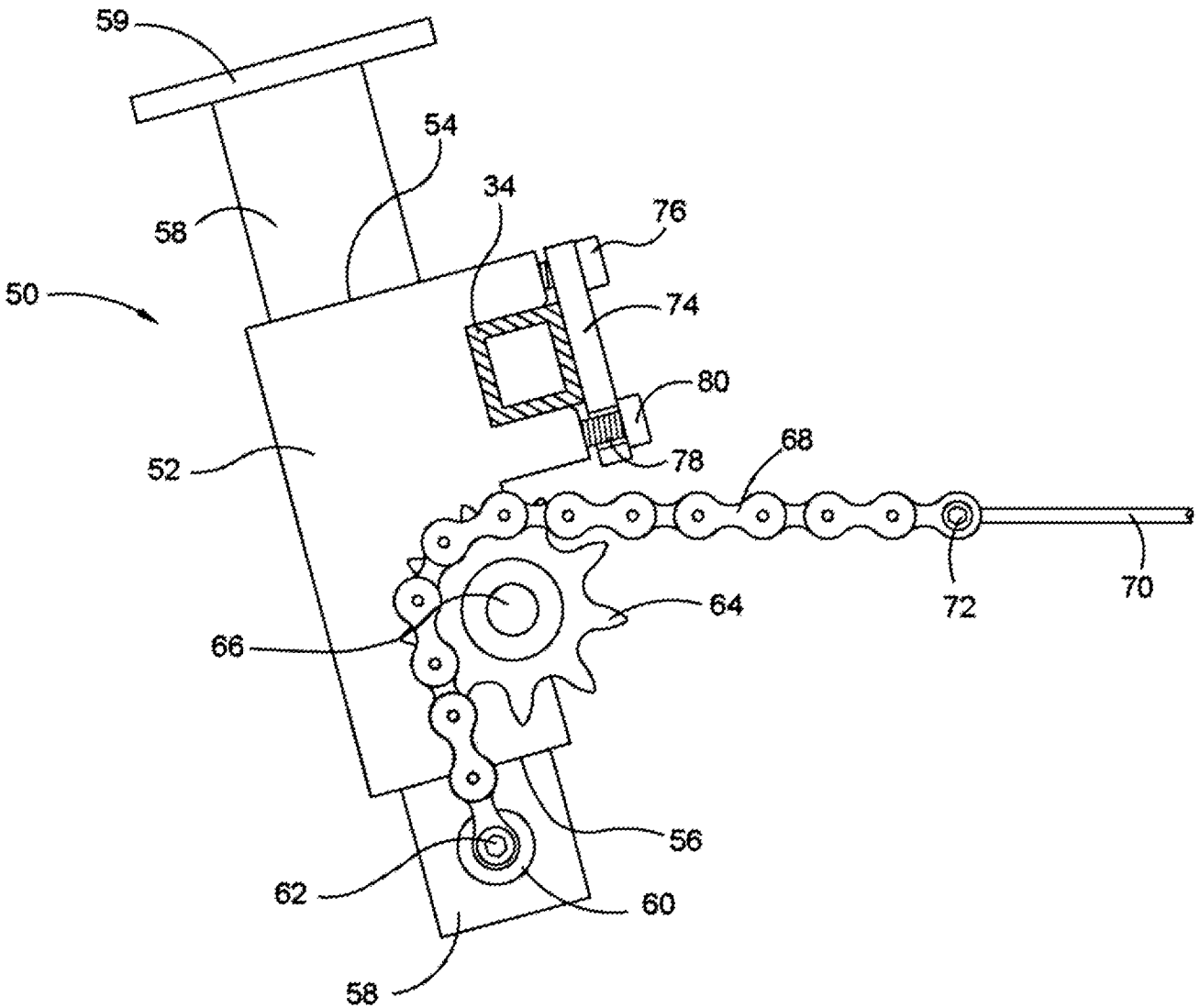
FIG. 2 is a sectional view, as indicated in FIG. 1, the view showing one of the pedal actuators of the invention.

Referring in particular to Drawing FIGS. 1 and 2, the instant inventive musical instrument assembly preferably incorporates at least a first cable pull actuator which is identified by Reference Arrow 50. The at least first cable pull actuator 50 preferably has a body portion 52 which defines a vertically extending slide channel having an upper opening 54 and a lower opening 56. A slide shaft 58 extends vertically through such slide channel, the slide shaft 58 having a foot contact pedal 59 attached to its upper end, and having a laterally extending lug 60 attached to its lower end, the lug 60 dually functioning as a slide stop and as a cable mount. A pull cable 70, which preferably incorporates a chain link section 68 attached by fastener link 72, is preferably fixedly attached to the lug 60 by fastener 62. A cable turning sprocket 64 is preferably rotatably mounted upon a laterally outer wall of the housing 52 by axle 66, such sprocket securely holding the cable 70 against lateral displacement and turning the link portion 68 of the cable 70 to a substantially horizontal extension. Forwardly directed tension applied to the cable 70 moves the slide shaft 58 and its pedal 59 to a normally upwardly extended position. Downwardly directed foot pressure applied to the pedal 59 oppositely drives the slide shaft 58 downwardly, pulling the extreme proximal end of the cable 70 (i.e., chain link 62) downwardly for application of a rearwardly directed pulling force to the pull cable 70.

Figure 2A:
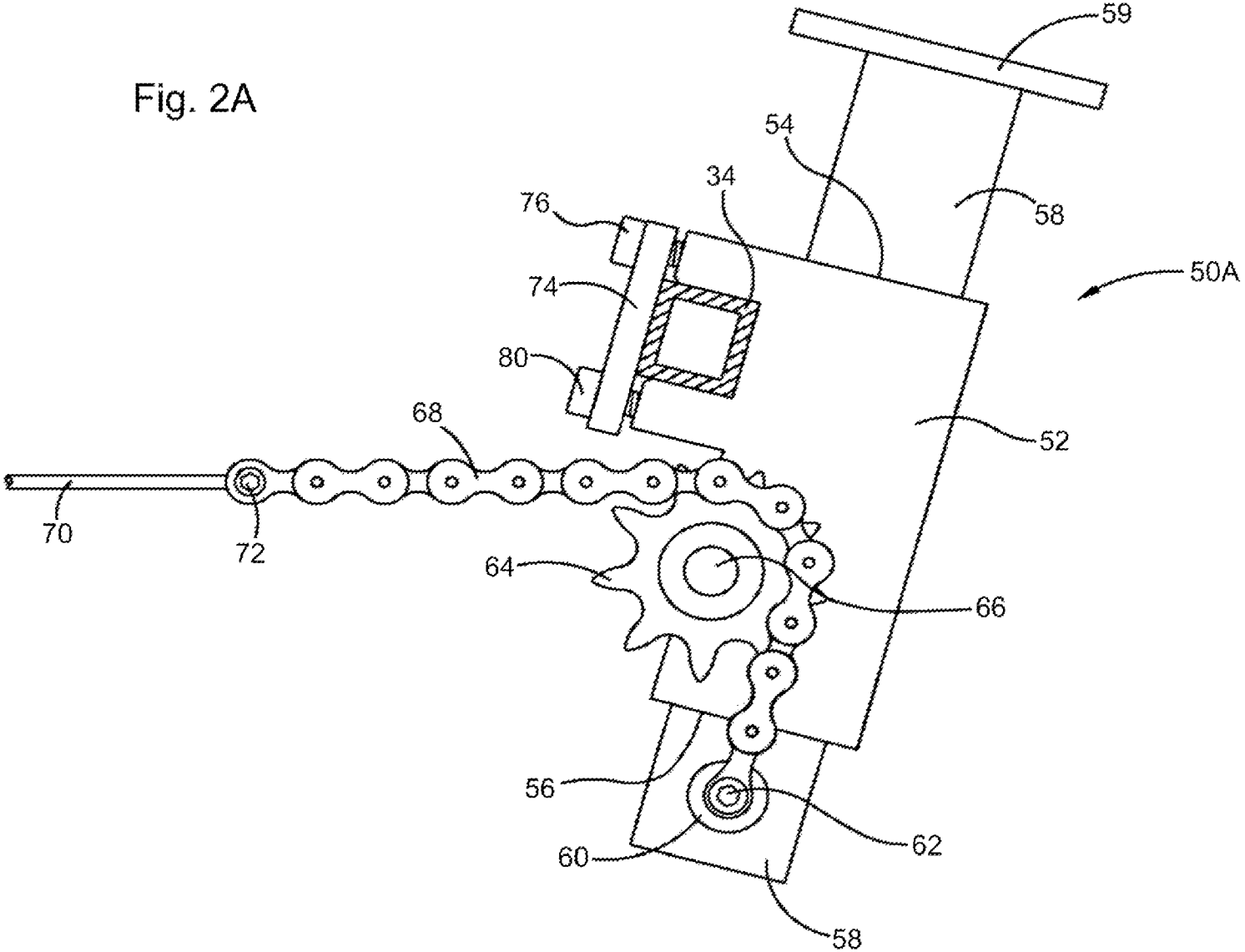
FIG. 2A is a reverse view of an alternatively configured pedal actuator.

FIG. 2A presents an alternatively configured cable pull actuator 50A which is identical to the FIG. 2 actuator, with the exception that sprocket 64 is mounted upon a laterally opposite side of the body 52. Such alternative pedal actuator configuration advantageously allows, referring further to FIG. 1, the cable pull actuators 50 and 50A to be arranged in substantial overlying and underlying orientations with respect to each other without any impinging interference between a lower end of a slide shaft 58 an underlying cable 68, 70. By positioning the sprockets 64 on either side of the actuator bodies 52, cables 70 are shifted laterally a distance equal to the lateral dimension of the bodies 52, such lateral shift preventing vertical interference.

In the preferred embodiment, a plurality of second cable pull actuators 51 are provided, each of such second cable pull actuators 51 preferably being configured substantially identically with the at least first cable pull actuator 50 or 50A. The at least first and second cable pull actuators 50 or 50A, and 51 are intended as being representative of various commonly known and commonly configured pedal actuator mechanisms capable of translating a downwardly directed force applied to a pedal into a laterally directed pulling force upon a cable.

Referring simultaneously to FIGS. 1, 2, 2A, the instant inventive musical instrument assembly preferably further comprises, at minimum, second mounting means for interconnecting the at least first cable pull actuator 50 or 50A upon at least a first lateral bar 34. In the preferred embodiment, the second mounting means comprises longitudinally opening "C" channels 35 which are closely fitted for slidably and nestingly receiving a lateral bar 30, 32, or 34. Releasable locking means referred to generally by Reference Arrow 73 are preferably provided, such means being mechanically associated with the openings of the "C" channels 35. The releasable locking means 73 preferably comprise pairs of Allen head screws 76 and 80. Swivel plates 74 having an upper eyes for rotatable receipt of screws 76 and having lower laterally opening "C" slots 78 are preferably provided for alternatively compressively locking a lateral bar 30, 32, or 34 within the "C" channel 35 and releasing such bar.

In use of the second mounting means as represented in Drawing FIG. 2, a musician wishing to release the depicted cable pull actuator 50 for remounting upon one of the other lateral bars 30 or 32, may initially apply an Allen wrench to screws 76 and 80, loosening such screws. Thereafter, the musician may rotate plate 34 about screw 76 until the opening of the "C" channel 35 is cleared. Thereafter, the cable pull actuator 50 may be manually moved away from the lateral bar 34 in a radial direction with respect to such bar's longitudinal axis, removing the bar 34 from the channel. Thereafter, the musician may reinstall the cable pull actuator 50 upon one of the other lateral bars 30 or 32 through a reversal of the detachment steps. Alternatively, in the event that the musician wishes to laterally reposition the cable pull actuator 50 along the lateral bar 34, the musician may simply loosen screws 76 and 80 until clamping pressure exerted by plate 74 against the lateral bar 34 is released. Thereafter, the musician may slidably move the cable pull actuator 50 in the lateral or oppositely lateral direction along lateral bar 34. During such repositioning, the channel 35, in combination with the plate 74, advantageously functions as a slide sleeve. Upon repositioning of the cable pull actuator 50 at a desired lateral location, screws 76 and 80 may be retightened for securely clamping and holding the cable pull actuator 50.

The second mounting means representationally depicted in FIG. 2 is preferably duplicated and presented at each of the other cable pull actuators 50A and 51, such duplication allowing all such actuators to be variably laterally positioned and interchangeably positioned with respect to the lateral bars 30, 32, and 34, and with respect to the support frame. The second mounting means configuration depicted in FIG. 2 is considered to be representative of other commonly known bar clamping joints which are capable of facilitating alternative clamping and sliding repositioning and facilitating radially directed bar attachments and detachments.

Figure 4:
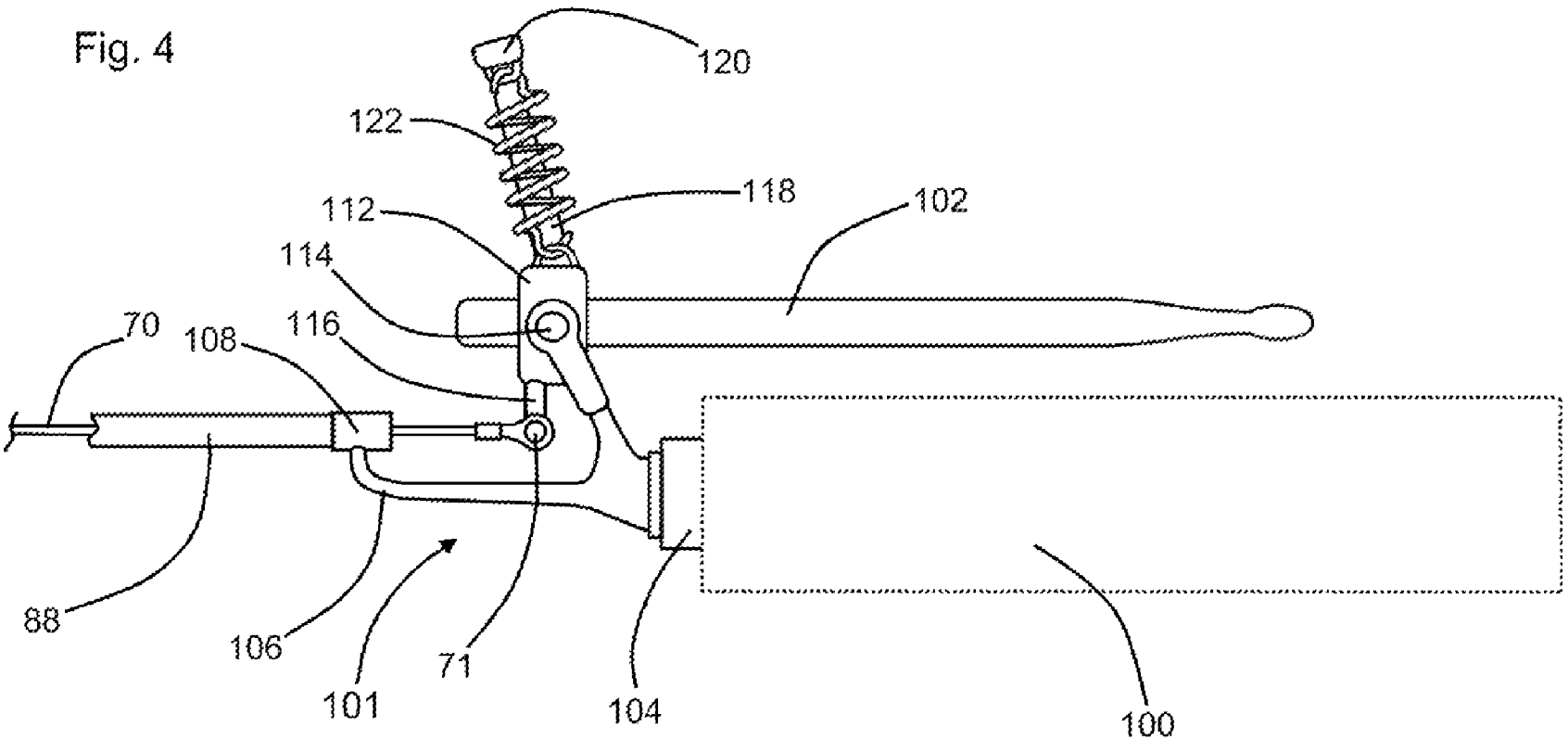
FIG. 4 depicts a representational percussion instrument, instrument striker, and striker driver assembly.

Referring simultaneously to FIGS. 1 and 4, the instant inventive musical instrument assembly preferably comprises at least a first percussion instrument which represented by dotted line box 100. The box 100 is intended as being representative of various types of percussion instruments, such as drums, cymbals, tambourines, and bells, which may be incorporated within and actuated as a part of the instant inventive assembly. Corresponding with the at least first cable pull actuator 50 or 50A and plurality of second actuators 51, depicted in FIGS. 1, 2, and 2A, at least a first and preferably a plurality of second such percussion instruments may be provided. Each such first and plurality of second percussion instruments 100 is preferably mechanically associated with an instrument striker such as a drum stick 102. Each of the assembly's percussion instruments 100 and instrument strikers 102 is preferably operatively interconnected by a striker driving assembly which is referred to generally by Reference Arrow 101. Such assembly 101 preferably comprises a base 104 which is preferably fixedly attached to or rigidly supportd in association with the percussion instrument 100. The distal end of the base 104 is preferably branched to present a cable anchoring arm 106 and a pivot mount arm 110. The pivot mount arm 110 is preferably further branched for double shear pivoting support by bearings 114 of a drum stick attachment collar 112. An "L" shaped spring attachment arm 118, 120 is preferably fixedly attached to and extends upwardly from the background arm 110 (not in view), and a spring 122 extends therefrom and attaches to the collar 112. An arm 116 preferably oppositely extends downwardly from collar 112 and pull cable 70 is preferably fixedly attached to the lower distal end of the arm 116 by a cable fastener 71. Pulling tension applied by the spring 122 to the upper end of the collar 112 is preferably rotatably countered by pulling tension from the cable 70, resulting in normal rarefaction of the spring 122, and resulting in the depicted substantially horizontal upstroke orientation of drum stick 102.

The striker and striker driver assembly are intended as being representative of various commonly known actuator mechanism which are capable of translating a pulling force (such as from cable 70) to pivotal movement of a striking element (such as striker 102).

Referring simultaneously to FIGS. 1 and 4, a plurality of striker driving assemblies 101 are preferably provided, each being incorporated within the instant inventive assembly for mechanical actuation via a flexible tube and cable combination. In such combinations, flexible tubes 88 preferably have their proximal and distal ends fixedly held in place in relation to the assembly's frame and the striker drivers. At the distal ends of the tube 88 and cable 70 combinations, tube clamping sleeves 108 preferably securely hold and mount the tubes 88 in relation to one of the striker drivers.

At the proximal ends of the tube 88 and cable 70 combinations, similar tube clamping sleeves 83 mounted upon the upper ends of vertical height adjustment posts 84 hold and fixedly position the proximal ends of the tubes 88. A pull cable 70 preferably extends through the hollow bore of each of the flexible tubes 88 for efficient translations of pedal actuated pulling forces to the striker driving assemblies 101.

Referring simultaneously to FIGS. 1, 2, 2A, and 4, since the cable pull actuators 50, 50A, and 51 are variably and adjustably positionable in the lateral and vertical directions, the lateral and vertical positions of the tube clamping sleeves 83 are preferably correspondingly adjustable for correct pull cable alignment. In order to facilitate such adjustability, referring further simultaneously to FIG. 2, "C" clamps 80 having releasable locking swivel plates 86 are provided. The "C" clamps 80 are preferably configured similarly with the "C" channels 35 and releasable locking means 73 of the cable pull actuators 50, 50A, and 51. The "C" clamps 80 are laterally slidable and repositionable along bar 12. The clamps 80 preferably further facilitate vertical height adjustment through cable support posts 84 which may be vertically repositioned by a musician through manipulation of set screws 82. Suitably, the posts 84 may be inverted within clamps 80 for downward height adjustment.

In order to facilitate further adjustability and flexibility in a musician's configuration of the instant inventive assembly, common rotatable adjustment means may be associated with the cable support post mounting "C" clamps 80. For example, such clamps may be configured for rotatable positioning and repositioning of the posts 84 and their tube clamping sleeves 83. Alternatively, the junctures of the tube clamping sleeves 83 with distal ends of posts 84 may be configured for pivoting motion. Such rotating and pivoting adaptations may advantageously allow the bores of the tube clamping sleeves 83 to remain aligned with cables 70 in situations where, referring to FIG. 2, the elevations of the sprockets 64 differ from the elevations of the tube clamping sleeves 83.

Referring to FIG. 1, the depicted array of cable pull actuators 50 is not necessarily representative of a configuration selected or preferred by a musician seeking to utilize the invention for foot actuation of multiple percussion instruments. Instead, the depicted array represents a universal positioning capability which is advantageously facilitated by the instant invention, such universal positioning including longitudinal positioning of each pedal actuator, vertical positioning of each pedal actuator, lateral positioning of each pedal actuator, and rotary positioning of each pedal actuator. Further universality in configuring the instant invention is reflected in its capacity for incorporating varying numbers of pedal actuators and varying numbers of cross bars supporting the pedal actuators. Further universality is reflected in the ability of the cable 70 and tube 88 assemblies to flexibly extend to and actuate percussion instruments at varying positions and locations about and surrounding the inventive assembly.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A musical instrument assembly comprising:

(a) a support frame having upper and lower ends, longitudinal and oppositely longitudinal ends, and lateral and oppositely lateral ends;

(b) at least a first lateral bar;

(c) first mounting means interconnecting the at least first lateral bar and the support frame;

(d) at least a first cable pull actuator, the at least first cable pull actuator having a normally extended contact pedal;

(e) second mounting means interconnecting the at least first cable pull actuator and the at least a first lateral bar;

(f) at least a first percussion instrument;

(g) at least a first instrument striker;

(h) at least a first driver operatively interconnecting the at least a first instrument striker and the at least a first percussion instrument; and (i) at least a first flexible tube and cable combination interconnecting the at least first cable pull actuator and the at least first driver for, upon retraction of the at least a first cable pull actuator's contact pedal, actuating the at least a first driver.

2. The musical instrument assembly of claim 1 wherein the first mounting means is adapted for vertically repositioning the at least first lateral bar with respect to the support frame.

3. The musical instrument assembly of claim 2 wherein the first mounting means is further adapted for longitudinally repositioning the at least first lateral bar with respect to the support frame.

4. The musical instrument assembly of claim 3 wherein the first mounting means is further adapted for rotatably repositioning the at least first lateral bar with respect to the support frame.

5. The musical instrument assembly of claim 1 wherein the second mounting means is adapted for laterally repositioning the at least first cable pull actuator with respect to the support frame.

6. The musical instrument assembly of claim 5 wherein the second mounting means is further adapted for facilitating attachments and detachments of the at least first cable pull actuator to and from the at least first lateral bar, said attachments and detachments being in radial directions with respect to the at least first lateral bar.

7. The musical instrument assembly of claim 1 further comprising pluralities of second lateral bars, second cable pull actuators, second percussion instruments, second drivers, and second flexible tube and cable combinations, and wherein the first mounting means is adapted for vertically repositioning each bar among the at least first and second lateral bars with respect to the support frame.

8. The musical instrument assembly of claim 7 wherein the first mounting means is further adapted for longitudinally repositioning each bar among the at least first and second lateral bars with respect to the support frame.

9. The musical instrument assembly of claim 8 wherein the first mounting means is further adapted for rotatably positioning each bar among the at least first and second lateral bars with respect to the support frame.

10. The musical instrument assembly of claim 7 wherein the second mounting means attaches at least one of the actuators among the at least first and second cable pull actuators to each of the bars among the at least first and second lateral bars.

11. The musical instrument assembly of claim 10 wherein the second mounting means is adapted for laterally repositioning each actuator among the at least first and second cable pull actuators with respect to the support frame.

12. The musical instrument assembly of claim 11 wherein the second mounting means is further adapted for facilitating attachments and detachments of each actuator among the at least first and second cable pull actuators to and from the at least first and second lateral bars, said attachments and detachments being in radial directions with respect to the at least first and second lateral bars.

13. The musical instrument assembly of claim 2 wherein the first mounting means' adaptation for vertically repositioning the at least first lateral bar comprises at least a first pair of vertically extending shafts slidably connected to the support frame.

14. The musical instrument assembly of claim 3 wherein the first mounting means' adaptation for longitudinally repositioning the at least first lateral bar with respect to the support frame comprises a plurality of longitudinally extending slide shafts connected to the support frame.

15. The musical instrument assembly of claim 4 wherein the first mounting means' adaptation for rotatably repositioning the at least first bar with respect to the support frame comprises at least a first pair of swivel joints.

16. The musical instrument assembly of claim 6 wherein the second mounting means' adaptations for laterally repositioning, attaching, and detaching the at least first cable pull actuator comprises a longitudinally opening "C" channel fitted for receiving the at least first lateral bar, the longitudinally opening "C" channel being connected to the at least first cable pull actuator.

17. The musical instrument assembly of claim 16 wherein the second mounting means' adaptations for laterally repositioning, attaching, and detaching the at least first cable pull actuator further comprises releaseable locking means connected operatively at the longitudinally opening "C" channel's opening.

18. The musical instrument assembly of claim 1 further comprising at least a first cable anchor operatively connecting the at least first flexible tube and cable combination to the support frame.

19. The musical instrument assembly of claim 7 further comprising at least a first and a plurality of second cable anchors, each anchor among the at least first and plurality of second cable anchors operatively connecting one of the flexible tube and cable combinations among the at least first and plurality of second flexible tube and cable combinations to the support frame.

20. The musical instrument assembly of claim 1 wherein the at least first cable pull actuator comprises an actuator shaft, slide sleeve, and cable turn combination, the pedal being fixedly attached to an upper end of the actuator shaft.

* * * * *